United States Patent [19]

Metzger

[11] Patent Number: 5,036,947

[45] Date of Patent: Aug. 6, 1991

[54] EXHAUST PIPE SHIELD

[76] Inventor: Jeffrey S. Metzger, 18785 Clearbrook St., Northridge, Calif. 91326

[21] Appl. No.: 525,843

[22] Filed: May 21, 1990

[51] Int. Cl.[5] ..... F01N 7/18

[52] U.S. Cl. ..... 181/241; 181/243; 181/211

[58] Field of Search ..... 181/211, 241, 243; 180/89.2

[56] References Cited

U.S. PATENT DOCUMENTS

| | | | |
|---|---|---|---|
| 3,237,716 | 3/1966 | Parsons | 180/89.2 |
| 3,495,673 | 2/1970 | Yazejian . | |
| 3,863,445 | 2/1975 | Heath | 60/299 |
| 3,963,087 | 6/1976 | Grosseau . | |
| 4,085,816 | 4/1978 | Amagai et al. | 180/89.2 |
| 4,478,310 | 10/1984 | Harster | 181/241 |
| 4,501,302 | 2/1985 | Harwood | 138/113 |
| 4,609,067 | 9/1986 | Gonwa | 181/211 |
| 4,612,767 | 9/1923 | Engquist et al. | 60/321 |
| 4,645,028 | 2/1987 | Kawashima | 180/227 |
| 4,656,712 | 4/1987 | Harwood et al. | 29/157 R |

*Primary Examiner*—Brian W. Brown
*Attorney, Agent, or Firm*—Harvey S. Hertz

[57] ABSTRACT

An exhaust pipe shield for motorcycles or the like comprises curved shield member having a generally constant radius greater than that of a cylindrically shaped exhaust pipe. A plurality of spacer blocks are interposed between the shield inner surface and the outer surface of the exhaust pipe. The spacer blocks are secured to the shield. A clamping mechanism is coupled to the spacer blocks for securing the shield to the exhaust pipe.

1 Claim, 1 Drawing Sheet

EXHAUST PIPE SHIELD

BACKGROUND OF THE INVENTION

1. Field of the Invention

The field of art to which the invention pertains includes the field of exhaust pipe shields, and more particularly, to a shield which can be easily secured to an exhaust pipe and which provides a maximum amount of protection from heat given off from the exhaust pipe.

2. Description of the Prior Art

Conventional exhaust pipe shields are secured to the exhaust pipe by various techniques. These techniques, however, normally necessitate a portion of the shield being in direct contact with the exhaust pipe. Thus, the temperature of the shield can be raised to a temperature which could be dangerous to the vehicle driver. In order to overcome such problems, relatively complex mechanisms or designs have utilized.

Known prior art includes U.S. Pat. Nos. 3,963,087; 3,863,445; 4,501,302; 3,495,673; 4,612,767; 4,645,028; 4,656,712; 3,237,716 and 4,085,816.

Typical of such prior art shields is shown in U.S. Pat. No. 3,237,716. In such an arrangement, the shield 30 contains a pair of legs 28 and feet 29 which are in contact with a muffler 15.

The present invention utilizes a curved shield member having a generally constant radius. The shield member is sufficiently spaced from the exhaust pipe so as to prevent direct contact with the exhaust pipe. Connection between the exhaust pipe and the shield provides a minimum of contact therebetween, while simultaneously, allowing airflow therebetween. Heat received from the pipe is easily dissipated by the shield member.

SUMMARY OF THE INVENTION

An exhaust pipe shield for motorcycles or the like includes a curved shield member having a generally constant radius greater than that of the cylindrically shaped exhaust pipe. A plurality of spacer blocks are interposed between the exhaust pipe shield inner surface and the outer surface of the exhaust pipe. The spacer blocks are secured to the exhaust pipe shield. A clamping mechanism, coupled to the spacer blocks secures the shield to the exhaust pipe.

The advantages of this invention, both as to its construction and mode of operation, will be readily appreciated when the same becomes better understood with respect to the accompanying drawings in which like reference numerals indicate like parts throughout the figures.

DESCRIPTION OF THE PREFERRED EMBODIMENT

Figure 1:
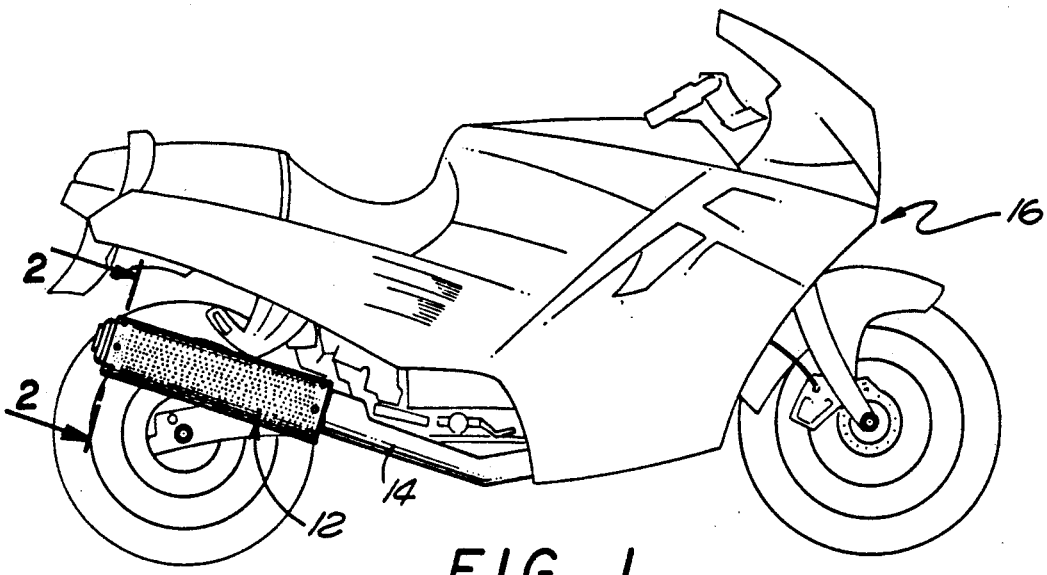
FIG. 1 is a perspective view of a motorcycle containing the exhaust pipe shield in accordance with the invention.

Referring now to the drawings, there is shown in FIG. 1 an exhaust pipe shield 12 mounted on the rear of an exhaust pipe 14 of a conventional motorcycle 16. The shield 12 is used to cover the rear portion of the exhaust pipe 14 which the motorcycle rider's feet normally could touch if not protected.

Figure 2:
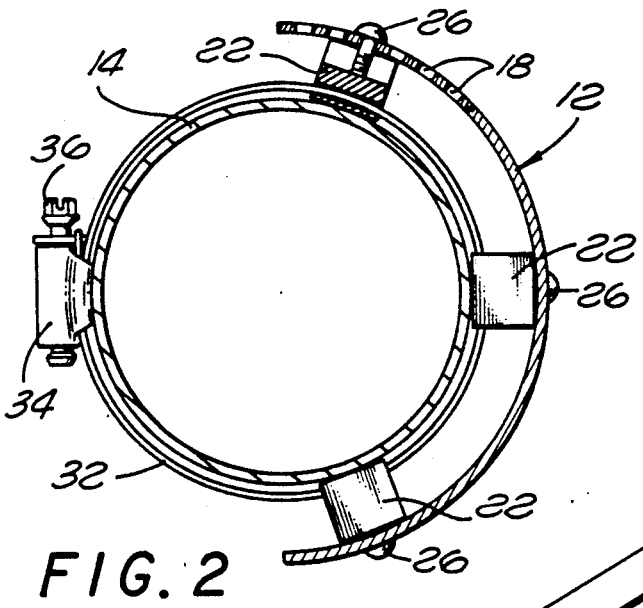
FIG. 2 is a cross-sectional view of the exhaust pipe shield of FIG. 1 connected to the exhaust pipe and taken along the line 2—2 of FIG. 1.
Figure 3:
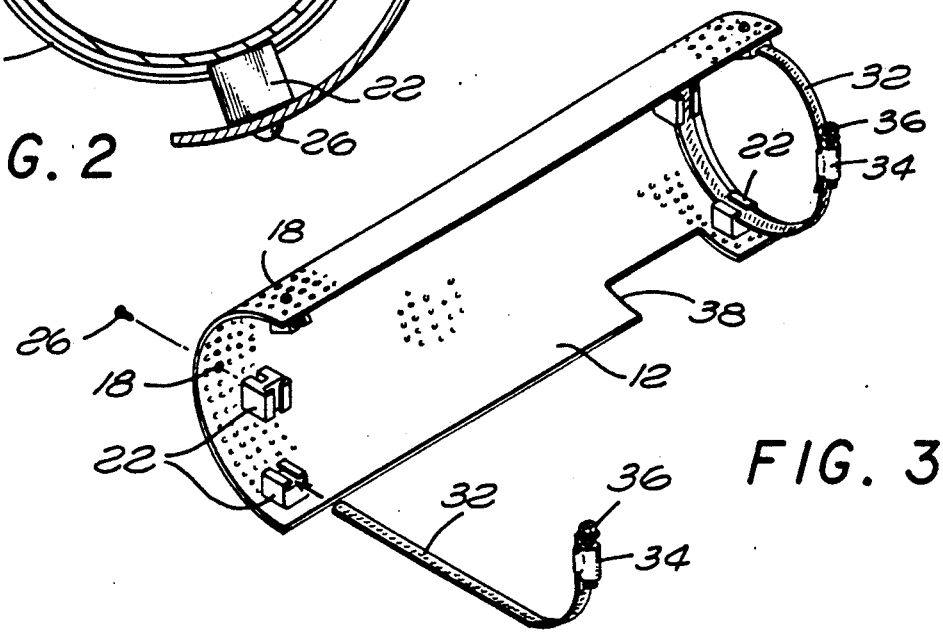
FIG. 3 is a partially exploded perspective view of the exhaust pipe shield of FIG. 1.

The exhaust pipe shield 12 is shown in greater detail in FIGS. 2 and 3 and comprises a generally semi-circular member spaced from the outer surface of the exhaust pipe 14. The exhaust pipe shield 12 contains a plurality of openings 18 formed in the shield surface enabling airflow therethrough to expedite cooling. A plurality of spacer blocks 22 abut the outer surface of the exhaust pipe 14 at either end of the shield 12 in a plane transverse to the axis of the exhaust pipe shield 12.

Figure 4:
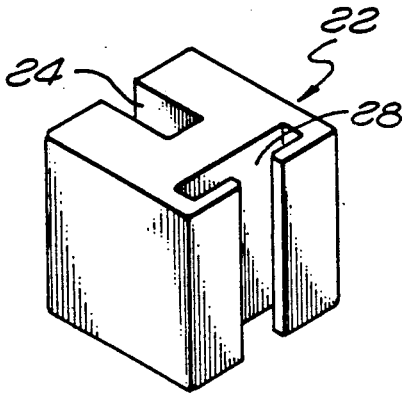
FIG. 4 is a perspective view of a spacer block utilized in the exhaust pipe shield of FIG. 3.

The spacer blocks 22 are shown in greater detail in FIG. 4 and are formed of generally rectangular blocks having a longitudinally extending screw receiving slot 24 extruded on the surface adjacent to the interior surface of the shield 12. A self-tapping screw 26 passes through one of the openings 18 in the shield surface and into the receiving slot 24. The screw 26 diameter is greater than the spacing of the receiving slot 24, thus securing the spacer block 22 to the shield 12. It should be noted that the screw receiving slot 24 could be eliminated and the screws directly secured to the body of the spacer block 22 by means of self-tapping screws or other conventional means. However, it has been found that the use of the slots eliminates the need for exact alignment of the openings 18 in the exhaust pipe shield and an opening in the spacer block 22.

The side of the spacer block 22 opposite the side receiving the screw receiving slot 24 contains a clamping band slot 28. As can be seen in FIG. 3, a clamping band passes through each of the slots 28 of each spacer block. The band 32 is part of a conventional hose clamp 34 having a bolt 36 whose rotation closes the hose clamp band 32 to secure the exhaust pipe shield 12 to the exhaust pipe 14.

As can be seen in FIG. 2, the connection between the exhaust pipe shield 12 and the exhaust pipe 14 is primarily throughout the spacer blocks 22. Thus, minimum of direct heat can be transferred to the exhaust pipe shield 12. Most of the heat from the exhaust pipe 14 transferred to the pipe shield 12 is via air flow in the space therebetween. This heat will easily be dissipated, thus maintaining the exhaust pipe shield 12 at a relatively safe temperature.

The opening 38 formed in the exhaust pipe shield is for clearance of the motorcycle foot peg (not shown) and forms no part of the invention.

I claim:

1. An exhaust pipe shield for a motorcycle exhaust pipe whose outer surface defines the outer surface of a cylinder comprising:

a curved shield member having an inner surface and an outer surface and having a generally constant radius greater than that of the cylindrically shaped exhaust pipe;

a plurality of sets of multi-sided spacer blocks interposed between said shield inner surface and the outer surface of said exhaust pipe; said spacer blocks being secured to said shield inner surface on one side thereof and abutting said outer surface of said exhaust pipe on the other side thereof; and clamping means coupled to said spacer blocks for securing said shield to said exhaust pipe, said clamping means including slots formed in said spacer blocks, a band extending through said slots of each set of said spaces blocks and means for securing said band to the outer surface of said exhaust pipe.

* * * * *